US009764363B2

(12) United States Patent
Zhang et al.

(10) Patent No.: US 9,764,363 B2
(45) Date of Patent: Sep. 19, 2017

(54) SPRAYING WASHING DEVICE OF DRUM WASHING MACHINE AND WASHING METHOD AND THE DRUM WASHING MACHINE

(75) Inventors: Huacheng Zhang, Qingdao (CN); Zeheng Li, Qingdao (CN); Yunfeng He, Qingdao (CN); Huibin Yang, Qingdao (CN)

(73) Assignees: HAIER GROUP CORPORATION, Qingdao, Shandong (CN); QINGDAO HAIER DRUM WASHING MACHINE CO., LTD, Qingdao, Shandong (CN)

( * ) Notice: Subject to any disclaimer, the term of this patent is extended or adjusted under 35 U.S.C. 154(b) by 434 days.

(21) Appl. No.: 14/362,051

(22) PCT Filed: Jun. 18, 2012

(86) PCT No.: PCT/CN2012/077077
§ 371 (c)(1),
(2), (4) Date: May 30, 2014

(87) PCT Pub. No.: WO2013/091362
PCT Pub. Date: Jun. 27, 2013

(65) Prior Publication Data

US 2014/0299164 A1 Oct. 9, 2014

(30) Foreign Application Priority Data

Dec. 19, 2011 (CN) ..... 2011 1 0427676

(51) Int. Cl.
*D06F 37/26* (2006.01)
*B08B 3/02* (2006.01)
(Continued)

(52) U.S. Cl.
CPC ..... *B08B 3/02* (2013.01); *D06F 35/008* (2013.01); *D06F 37/28* (2013.01); *D06F 39/088* (2013.01); *D06F 39/14* (2013.01)

(58) Field of Classification Search
CPC ..... D06F 35/008; D06F 37/28; D06F 39/088; D06F 39/14
See application file for complete search history.

(56) References Cited

U.S. PATENT DOCUMENTS

2008/0169034 A1* 7/2008 Schroeder ..... D06F 33/02 137/624.13
2011/0083477 A1 4/2011 Kim et al.
(Continued)

FOREIGN PATENT DOCUMENTS

CN 2372345 Y 4/2000
CN 201058940 Y 5/2008
(Continued)

OTHER PUBLICATIONS

Machine Translation of Kim et al., CN 101824722 A, Sep. 2010.*
(Continued)

*Primary Examiner* — David Cormier
(74) *Attorney, Agent, or Firm* — Buchanan Ingersoll & Rooney PC

(57) ABSTRACT

A drum washing machine is provided with a double spraying system used for washing the window and the window gasket ring respectively. A first spraying nozzle is connected with the inlet solenoid valve of the washing machine to wash the outer surface of the watching window and the window gasket ring, and a second spraying nozzle to wash the folded inner wall of the window gasket ring. The spraying nozzles are connected to the solenoid valve through a three-way pipe, or connected to the solenoid valve of the washing machine through respective pipes. The double spraying system intakes water and soaks the clothes in the washing
(Continued)

process, and/or intakes water and sprays the watching window and the window gasket ring simultaneously, and/or sprays the watching window and the window gasket ring when dehydrating the clothes in the dehydrating process.

5 Claims, 7 Drawing Sheets

(51) Int. Cl.

| | |
|---|---|
| ***D06F 39/08*** | (2006.01) |
| ***D06F 39/14*** | (2006.01) |
| ***D06F 37/28*** | (2006.01) |
| ***D06F 35/00*** | (2006.01) |

(56) References Cited

U.S. PATENT DOCUMENTS

| | | | |
|---|---|---|---|
| 2011/0099727 | A1 | 5/2011 | Kim et al. |
| 2011/0146002 | A1 | 6/2011 | Kim et al. |

FOREIGN PATENT DOCUMENTS

| | | | |
|---|---|---|---|
| CN | 101824722 | A | 9/2010 |
| CN | 201722522 | U | 1/2011 |
| DE | 197 31 667 | A1 | 1/1999 |
| DE | 10 2005 055 776 | A1 | 5/2007 |
| DE | 102010038969 | A1 | 2/2011 |

OTHER PUBLICATIONS

Extended European Search Report dated Jul. 13, 2015, issued by the European Patent Office in the corresponding European Application No. 12859206.0 (7 pages).

Office Action dated Aug. 21, 2015, issued by the Japanese Patent Office in corresponding Japanese Patent Application No. 2014-546285 (3 pages).

International Search Report (PCT/ISA/210) mailed on Sep. 27, 2012, by the Chinese Patent Office as the International Searching Authority for International Application No. PCT/CN2012/077077.

* cited by examiner

SPRAYING WASHING DEVICE OF DRUM WASHING MACHINE AND WASHING METHOD AND THE DRUM WASHING MACHINE

FIELD OF THE INVENTION

The invention relates to a cleaning medium for washing clothes, especially a device that can add water to evenly soak the clothes in washing, and clean the watching window and the window gasket ring in rinsing and dehydrating, and a drum washing machine.

BACKGROUND OF THE INVENTION

In the process of washing and rinsing of a drum washing machine, there are foam and debris attaching on the watching window and the window gasket ring after finishing washing due to the gap, the flow angle and so on, and the foam and debris can not be flushed. The foam and the residual detergent induce some problems, such as affecting the washing effect seriously and contaminating clothes. Specifically, it is easy to pollute the clothes again when removing them out. And the residual trash line and sediment are accumulated on the sidewall and in the wrinkle of the window gasket ring easily, which causes the growth of bacteria easily, affects the washing effect and healthy life.

At present all the washing machine manufacturers take various measures on the problem that the foam and debris attaching between the watching window and the window gasket ring, such as leading spraying water to eliminate the foam, and clean the residual detergent. The following methods mainly are adopted: 1. adding spraying pump directly for cleaning circularly; 2. leading out water for spraying from the main washing cavity of the water separator; 3. leading out water for spraying from the rinsing cavity of the water separator; 4. leading out water for spraying from the inlet pipe directly. The above several methods have some disadvantages such as complicated structure, high cost, large electricity consumption, diseconomy and large water consumption, not good washing effect.

The most common spraying method is to spray the clothes during supplying water, to achieve better washing effect. If the washing machine connects a water flow through the solenoid valve during supplying water, and directly connects to the top of the window gasket ring. The water flow sprays the clothes directly when supplying water, and quickly wet the clothes, to improve washing efficiency. Meanwhile, the water flow flows through the watching window to flush the foam on the watching window. The device is mainly composed of a water supply hose, a solenoid valve and a spraying nozzle.

The most foam on the watching window is the one spilled on the watching window in the dehydrating clothes process. If supplying water to flush the watching window again after the clothes dried, the dried clothes are soaked again, so the drying process is insignificant. And the present scheme can not flush to the window gasket ring, especially there is no corresponding method for cleaning the fold position of the window gasket ring. It leads to the accumulation of the dirt and breeding bacteria, seriously affecting the washing effect.

In addition, Chinese Application No: CN200720038617.8 discloses a water separator of the drum washing machine adding the cleaning spraying device, specifically, adding a flushing water channel that can flush the residual detergent and the foam in the softener cavity of the water separator of the drum washing machine. The flushing water channel forms a water flowing that provides flushing to the softener cavity of the water separator, and a water flowing for flushing the residual detergent and the foam on the watching window and the window gasket ring through the spraying outlet. But according to the application documents, the actual technical scheme is unable to clean the watching window and the window gasket ring completely and effectively.

In view of this, the invention is provided.

SUMMARY OF THE INVENTION

The object of the present invention is to overcome the disadvantages of the prior art, to provide a spraying washing method for washing the watching window and the window gasket ring of the drum washing machine, avoid the accumulation of the dirt in the fold of the window gasket ring and breeding bacteria.

Another object of the present invention is to provide a spraying washing device used for the spraying washing method.

Another object of the present invention is to provide a drum washing machine with the spraying washing device.

In order to solve the technical problem, the technical scheme of the invention is that:

a spraying washing device of drum washing machine, includes an inlet solenoid valve, an inlet pipe and a three-way pipe connected in sequence, the inlet solenoid valve is connected with a controller of the washing machine, the three-way pipe is connected with a first spraying nozzle for washing an outer surface of a watching window and a window gasket ring and a second spraying nozzle for washing a inner wall of a fold of the window gasket ring through two bypass pipes respectively.

Alternatively, as an alternative to the above scheme, a spraying washing device of drum washing machine of the present invention is a double spraying system for washing the watching window and the gasket ring respectively, which comprises a first spraying nozzle for washing the outer surface of the watching window and the window gasket ring, and a second spraying nozzle to wash the folded inner wall of the gasket ring, both the first spraying nozzle and second spraying nozzle are connected with the inlet valve of the washing machine. The first spraying nozzle and the second spraying nozzle are connected with the inlet valve through water pipes respectively. Preferably, the inlet valve of the washing machine is a solenoid valve with one inlet and several outlets for controlling the water inlet path respectively.

The window gasket ring in the invention is arranged between a feeding clothes opening of a door of the washing machine and an opening of an outer cylinder. The window gasket ring is bent to form a groove-shaped fold on the front of the opening of the outer cylinder. The second spraying nozzle is arranged in the groove-shaped fold through the window gasket ring from the right top.

Further, the second spraying nozzle is provided with a spraying mouth on both sides of the circumferential direction of the window gasket ring. The water sprays from the spraying mouth on both sides, flows along the inner wall of the groove-shaped fold, and converges on the bottom. After washing the inner surface of the groove-shaped fold, the water is drained into the outer cylinder from the water outlet on the bottom of the window gasket ring. Or, the second spraying nozzle is a cylindrical structure, of which the end is closed, the side wall is provided with a plurality of spraying hole.

The first spraying nozzle is through the window gasket ring, and is arranged on the above position near to the watching window. The spraying mouth of the first spraying nozzle is toward the watching window and the window gasket ring, which makes the water flow down along an outer surface of the watching window and the window gasket ring after spraying, and finishes cleaning the outer surface of the watching window and the window gasket ring.

Preferably, the first spraying nozzle includes a water inlet and a spraying mouth, and forms a L-shaped flow passage. The spraying mouth is trumpet-shaped or flat fan-shaped. The spraying flow is spraying in the shape of a diffused fan. A fan-shaped angle of the spraying mouth is 30° to 150°.

A washing method of the spraying washing device in the invention, the spraying washing device is a double spraying system for washing the watching window and the gasket ring respectively. Through the double spraying system, water is sprayed onto the clothes for wetting during washing, and/or added and sprayed for washing the watching window and the window gasket ring simultaneously during rinsing, and/or sprayed for washing the watching window and the window gasket ring when dehydrating the clothes in dehydrating process.

A process for washing the window gasket ring in the invention comprises washing an outer surface of the window gasket ring and the inner wall of the fold.

Further, in the washing process, first the double spraying system is started for adding water in a set period in a spraying manner to soak the clothes. Then the water through the flushing waterway flushes a liquid detergent or solid detergent. After completing flushing the liquid detergent or solid detergent, the double spraying system is started for adding water until a set water level again, closing the double spraying system, and starting washing. Because the quantity of water is controlled during adding water through the double spraying system, the clothes is wetted evenly and the concentration of the liquid or solid detergent on the clothes is relatively high in a period of time, thus achieves the purpose of bathing, and conducive to wash clothes.

In rinsing process, the double spraying system is started for spraying the watching window and the window gasket ring with water. Until the sprayed water is up to a set water level, the double spraying system is close, and then starting rinsing. In this process, the foam and dirt which is remained on the watching window and the window gasket ring in washing process are flushed into the outer cylinder first. The possibility of contamination is further reduced when the clothes is dewatered.

Further, during washing and rinsing, the double spraying system is started for adding water for 1 to 4 min, preferably 1 to 2 min.

In dehydrating process, the double spraying system is started for at lease twice for spraying the watching window and the window gasket ring with water. Preferably, during running a clothes distribution program, when the rotating speed of the drum reaches a spraying speed before and after the highest set speed, the double spraying system is started respectively. It is avoided that the washing water and the trash line thrown on the watching window and in the window gasket ring in dehydrating process contaminate the clothes again by repeatedly spraying and washing.

The specific working steps of the double spraying system in dehydrating process are: draining to a set water level of empty tub; running the clothes distribution program, and the double spraying system being started for spraying the watching window and the window gasket ring for 1 to 20 s when the rotating speed is up to the set spraying speed; the speed of the drum continuing to increase, until it reaches the set highest speed; when the speed of the drum is reduced to the set spraying speed again, the double spraying system being started again for spraying the watching window and the window gasket ring for 1 to 20 s. Preferably, the time of adding water through the double spraying system is 3-20 s The step of the dehydrating process further comprises, the double spraying system is started for spraying the watching window and the window gasket ring for 1 to 20 s after draining to the set water level of empty drum and before running the clothes distribution program.

In the washing method of the invention, due to the quantity of spraying water being controlled less, the concentration of the liquid or solid detergent relatively increases. It achieves the purpose of bathing, and conducive to wash clothes. In rinsing and dehydrating process, the watching window and the window gasket ring are repeatedly sprayed for washing, thus can prevent the clothes contaminating once again, and is beneficial to the health of users.

The drum washing machine in the invention adopts the method of washing the watching window and the window gasket ring.

In the invention, the window gasket ring of the drum washing machine is arranged between the feeding clothes opening of the door of the washing machine and the opening of the outer cylinder, and the window gasket ring is bent to form a groove-shaped fold on the front of the opening of the outer cylinder, to get better effect of sealing and buffering. In washing process, the washing water enters in the groove-shaped fold of the window gasket ring, and part of the washing water can be drained to the outer cylinder from the outlet located in the fold of the bottom of the window gasket ring, but there is detergent foam, trash line, sediment and so on remained easily in the fold. Since the position of the fold is in the wet state in the long-term, it is easy to breed bacteria, and cause secondary pollution to the clothes.

To solve the problems that the detergent, trash line and the sediment remained on the watching window and in the window gasket ring are difficult to clean and cause secondary pollution to the clothes, the invention provides a method for spraying and washing the watching window and the window gasket ring by utilizing the double spraying system. The double spraying system washes the watching window and the window gasket ring simultaneously. The double spraying system comprises a first spraying nozzle for washing the outer surface of the watching window and the window gasket ring, and a second spraying nozzle for washing the inner wall of the fold of the gasket ring, which is connected with the inlet solenoid valve of the washing machine. The first spraying nozzle is through the window gasket ring, and arranged on the top position near to the watching window, and can directly spray the washing water on the watching window and the window gasket ring to wash the watching window and the window gasket ring overall. The direction of the spraying mouth of the first spraying nozzle is the key influence on the washing effect. The spraying mouth of the first spraying nozzle is toward the outer surface of the watching window and the window gasket ring, so the spraying water sprays directly onto the watching window for washing it, and does not enter the inside of the drum to wet the clothes. The second spraying nozzle is arranged in the groove-shaped fold through the window gasket ring, and the spraying water can flush the dirt remained in the fold, complete the cleaning of the inside of the window gasket ring.

With the above technical scheme, the invention has the following beneficial effects compared to the prior art.

The drum washing machine in the invention adds a double spraying system on the basis of the structure of the prior washing machine, finish cleaning the watching window and the window gasket ring, and avoid the secondary pollution to the clothes. The improvement structure is simple. In addition, the double spraying system can increase relatively the soaking effect of clothes before washing, conducive to wash clothes. The structure of the spraying washing device in the invention is simple, the production cost is low. Moreover, the washing method in the invention is simple and easy, suitable for popularization, and with good cleaning effect. It is better to avoid the secondary pollution caused by the watching window and the window gasket ring.

The embodiments of the invention are further described in combine with the drawings.

EMBODIMENTS

Figure 1:
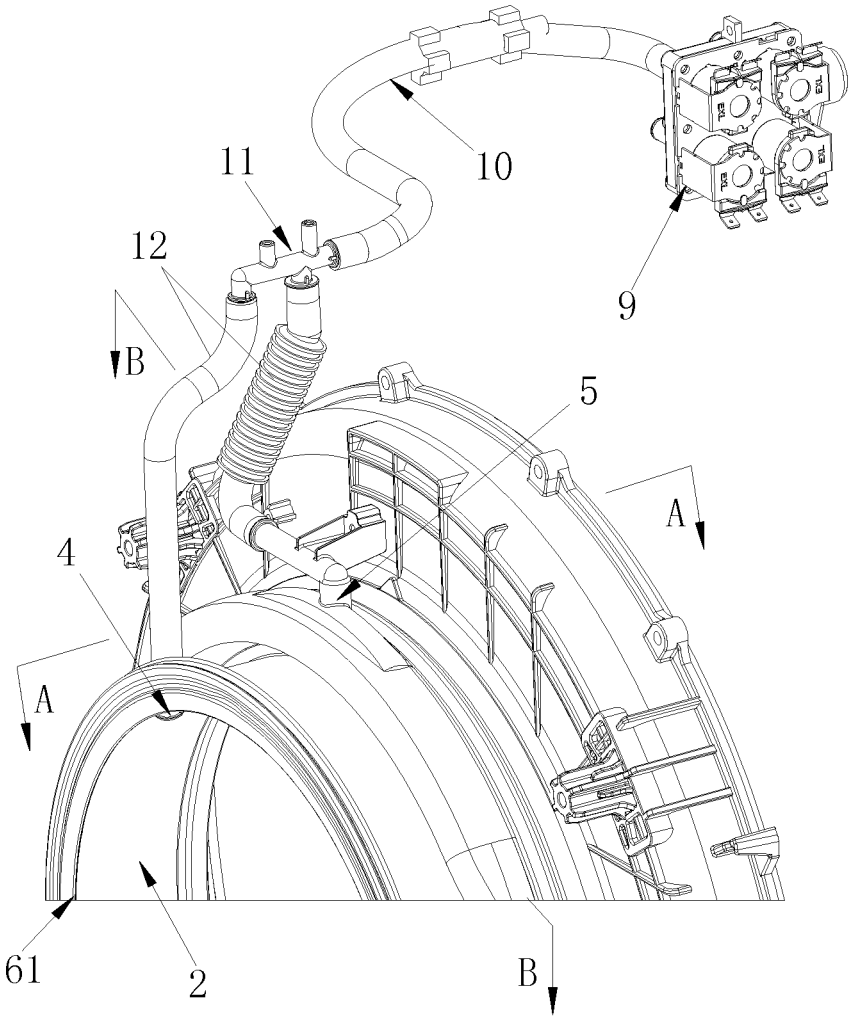
FIG. 1 shows a schematic illustration of installing structure of the spraying washing device of the present invention.

As shown in FIGS. 1-4, a spraying washing device of the invention is a double spraying system for washing a watching window 1 and a window gasket ring 2 respectively. The spraying washing device comprises a first spraying nozzle 4 for washing an outer surface of the watching window 1 and the window gasket ring 2, and a second spraying nozzle 5 for washing the folded inner wall of the window gasket ring 2, which connect with an inlet valve 9 of the washing machine respectively. The device can supply water to wet the clothes, achieve to soak with high concentration of the washing detergent or washing powder, conducive to wash clothes, and flush the watching window and the window gasket ring by spraying in rinsing and dehydrating process.

In the invention, the window gasket ring 2 of the drum washing machine is arranged between a feeding clothes opening 61 of a door 6 of the washing machine and an opening of an outer cylinder 7. The window gasket ring 2 is bent to form a groove shaped fold 8 on the front of the opening of the outer cylinder 7 (referring to FIG. 2), to get better effect of sealing and buffering.

Embodiment 1

As shown in FIG. 1, the spraying washing device for washing the watching window 1 and the window gasket ring 2, includes an inlet pipe 10 and a three-way pipe 11 connected in sequence with the inlet valve 9 of the washing machine. The inlet valve 9 being solenoid valve is connected with a controller of the washing machine. The three-way pipe 11 is connected to a first spraying nozzle 4 for washing the outer surface of the watching window 1 and the window gasket ring 2 and a second spraying nozzle 5 for washing the inner wall of the fold 8 of the window gasket ring 2 through two bypass pipes 12 respectively. After the solenoid valve 9 is opened, water enters the inlet pipe 10, and spray on to the surface and the inner wall of the fold of the watching window 1 and the window gasket ring 2 from the first spraying nozzle 4 and the second spraying nozzle 5 after distributing flows by the three-way pipe 11.

Figure 2:
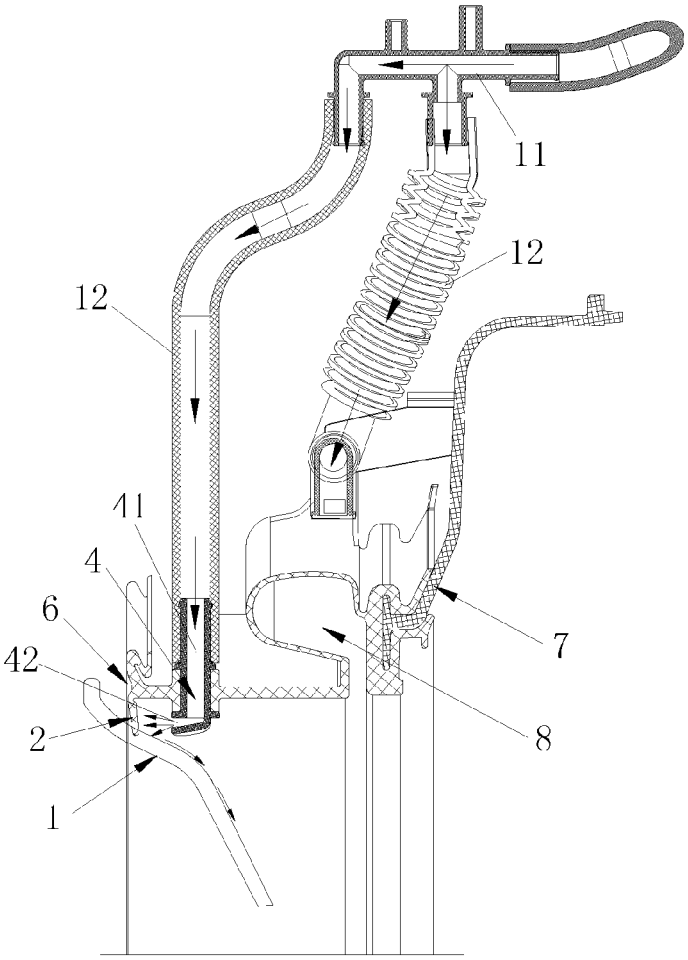
FIG. 2 shows a schematic illustration of the local section diagram along A-A in FIG. 1 after installing the washing machine door.
Figure 3:
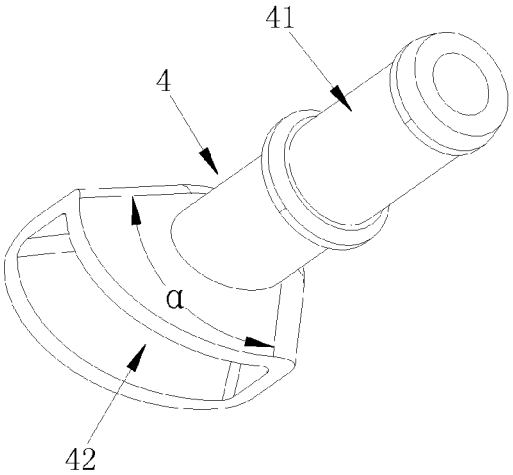
FIG. 3 shows a schematic illustration of the structure of the first spraying nozzle of the present invention.

Specifically, as shown in FIG. 2, the first spraying nozzle 4 is through the window gasket ring 2, and is arranged on the top of the window gasket ring 2 near to the watching window 1. A spraying mouth 41 of the first spraying nozzle 4 is toward the watching window 1 and the window gasket ring 2, which makes the water flow down along the outer surface of the watching window 1 and the window gasket ring 2 after spraying, and finishes cleaning the outer surface of the watching window and the window gasket ring. As shown in FIG. 3, the first spraying nozzle 4 includes a water inlet 41 and a spraying mouth 42, forming an L-shaped flow passage. The spraying mouth 42 is flat fan-shaped, the spraying flow is spraying in the shape of the diffused fan. A fan-shaped angle of the spraying mouth is 30° to 150°, preferably, the fan-shaped angle is 30°, 60°, 90°, 105°, 120°, or 150°. The direction of the spraying mouth of the first spraying nozzle is the key influence on the cleaning effect. In the embodiment, the spraying mouth of the first spraying nozzle is toward the watching window (back on to the drum). Therefore, the spraying water from the first spraying nozzle sprays directly the watching window and the window gasket ring near to clean them. The spraying water flows along the watching window and the window gasket ring after spraying, and flushes effectively the surface of the watching window and the window gasket ring, and can not enter the inside of the drum to wet or pollute clothes.

Figure 4:
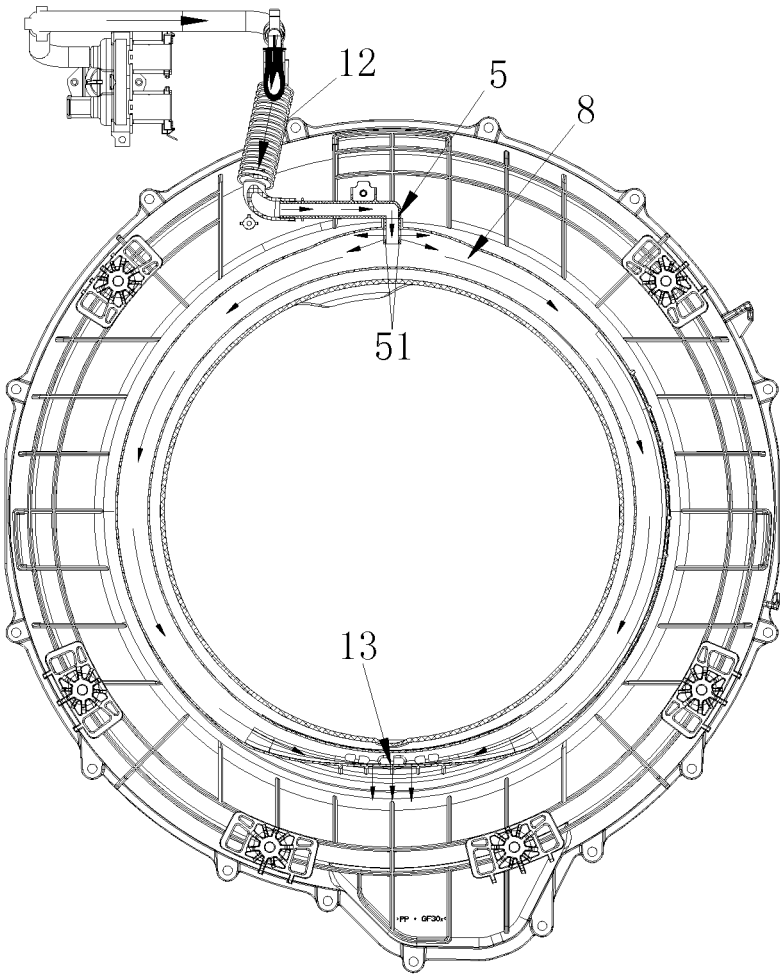
FIG. 4 shows a schematic illustration of the local section diagram along B-B in FIG. 1.

As shown in FIG. 4, the second spraying nozzle 5 is provided with a spraying mouth 51 along the both sides of the circumferential direction of the window gasket ring 2. The water sprays from the spraying mouth 51 on both sides, flows along the inner wall of the groove-shaped fold 8, and converges on the bottom. After cleaning the inner surface of the groove-shaped fold, the water is drained into the outer cylinder from the water outlet 13 on the bottom of the window gasket ring. At this time, the spraying water can flush the dirt remained in the fold of the window gasket ring absolutely, completing cleaning the inner of the fold of the window gasket ring.

The structure of the spraying washing device is simple, which adds a three-way pipe and double spraying systems on the basis of the structure of the prior washing machine, and can finish cleaning the watching window and the window gasket ring. Thus avoids the secondary pollution to the clothes. The invention has low production cost, high practicability, and is suitable for popularizing use.

Embodiment 2

The only difference from Embodiment 1 is that, the first spraying nozzle and the second spraying nozzle are connected with the inlet valve through water pipes respectively. According to the washing time, the washing process or other conditions, the inlet valve controls respectively the water to flow to the first spraying nozzle or the second spraying nozzle. Preferably, the inlet valve of the washing machine is a solenoid valve with one inlet and several outlets for controlling the water path respectively.

Embodiment 3

The only difference from Embodiment 1 is that: the spraying mouth of the first spraying nozzle is trumpet-shaped, and the spraying water is spraying in the shape of the diffused circumference. The central angle is 45° to 150°, preferably, the central angle is 60°, 75°, 90°, 120°, or 150°. At this time, the spraying flow from the first spraying nozzle diffusely cleans the whole watching window and flush the outer surface of the window gasket ring, to obtain the best cleaning effect.

Embodiment 4

The only difference from Embodiment 1 is that: the second spraying nozzle is arranged on the center of the right above the of the window gasket ring. The second spraying nozzle is a cylindrical structure, of which the end is closed end, the side wall is provided with a plurality of spraying hole. The washing water sprays from the spraying hole, and sprays to surrounding. Part of the spraying water on the front and rear wall of the window gasket ring is blocked and sputters to both sides, and ultimately integrates two water flows to flush along the circumferential direction of the groove-shaped fold, then flows along the inner wall of the groove-shaped fold to converge at the bottom, and finally the water is drained into the outer cylinder from the outlet on the bottom of the groove-shaped fold.

Embodiment 5

Figure 5:
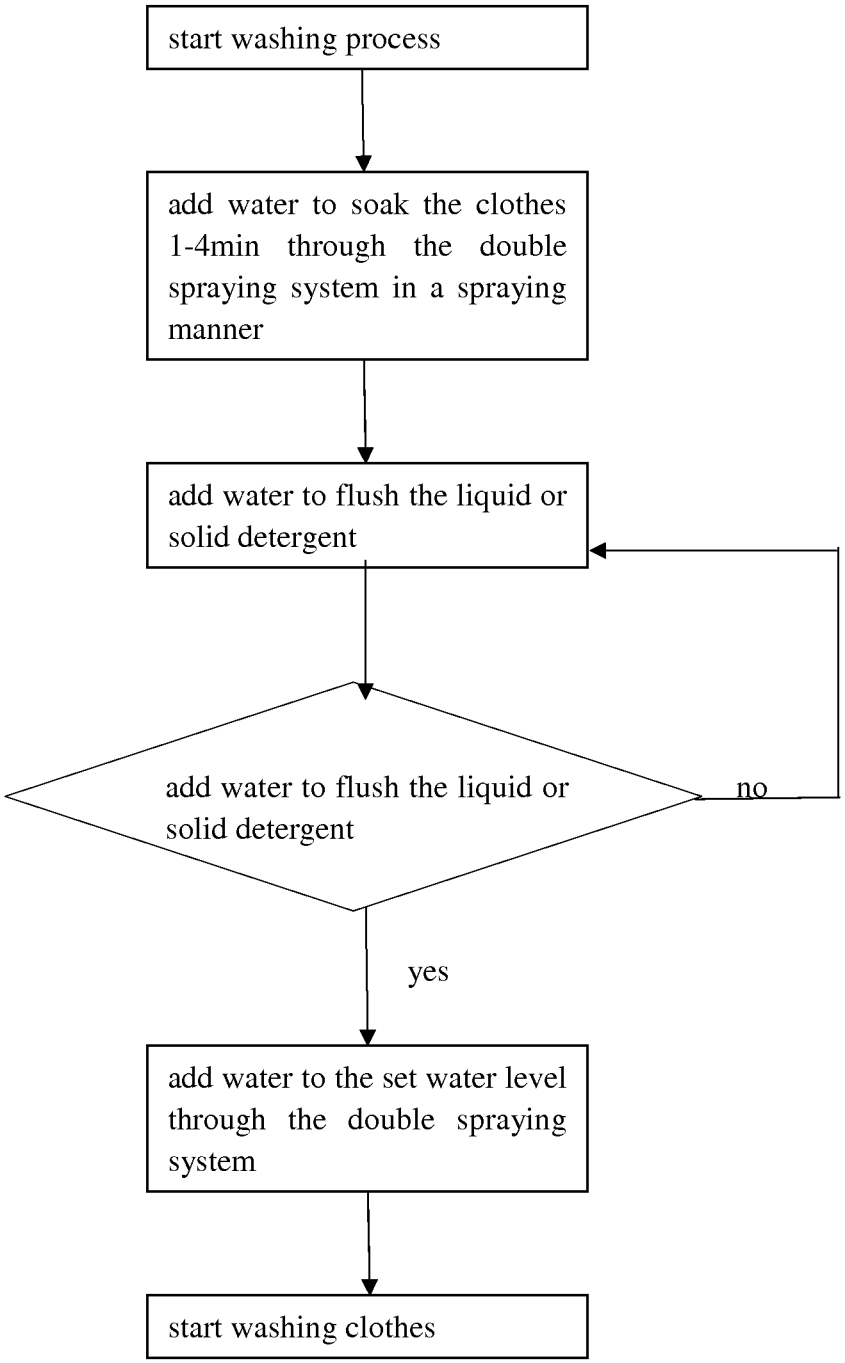
FIG. 5 shows a schematic illustration of the work flow of the double spraying system of the present invention in washing process.

The embodiment adopts the following technical scheme to realize the washing process, as shown in FIG. 5, the work flow of the double spraying system is:

In the washing process, after putting the clothes in the washing machine, first opening the double spraying system for adding water about 1-4 min in a spraying manner to soak the clothes, Preferably 1-2 min. Then the water through the flushing waterway flushes the liquid detergent or solid detergent. After completing flushing the liquid detergent or solid detergent, the double spraying system is started for adding water until a set water level again, closing the double spraying system, and starting washing. Because the quantity of water is controlled during adding water through the double spraying system, the clothes is wetted evenly and the concentration of the liquid or solid detergent is relatively high in a period of time, thus achieves the purpose of bathing, and conducive to wash clothes.

Embodiment 6

Figure 6:
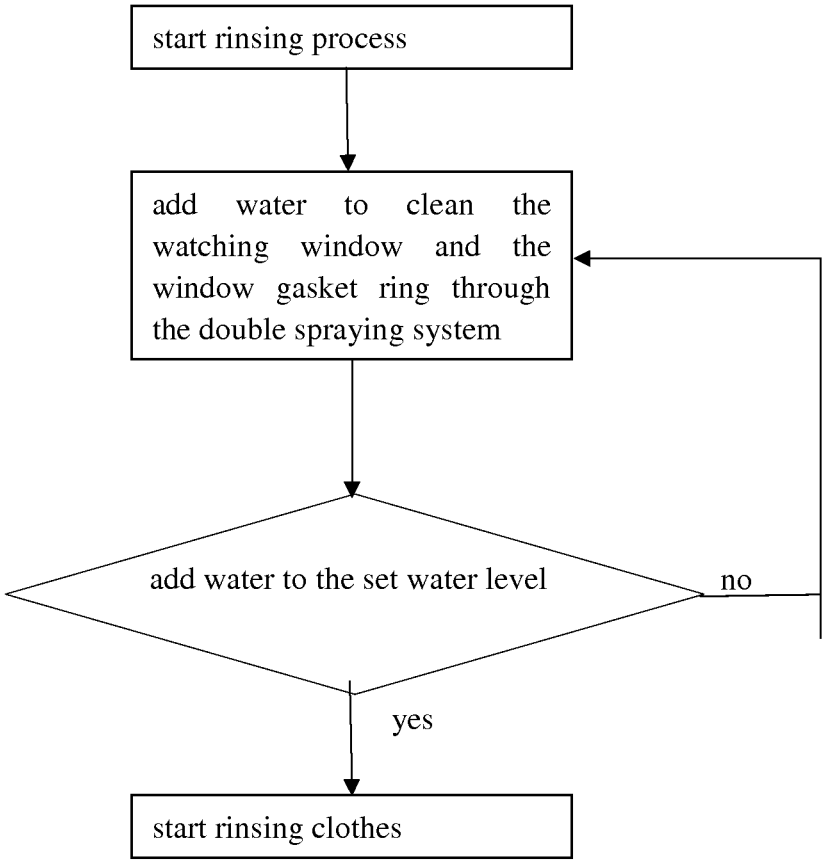
FIG. 6 shows a schematic illustration of the work flow of the double spraying system of the present invention in rinsing process.

The embodiment adopts the following technical scheme to realize washing the watching window and the window gasket ring in the rinsing process. The washing method in the rinsing process of the embodiment can use alone, and also can use in combine with Embodiment 5. As shown in FIG. 6, the work flow of the double spraying system is:

Rinsing begin, the double spraying system is started to spray the watching window and the window gasket ring, until the sprayed water is detected to a set rinsing water level, then starting rinsing clothes; if detected not to the set rinsing water level, starting the double spraying system again for spraying the watching window and the window gasket ring. In this process, the washing foam and dirt which is remained on the watching window and the window gasket ring in washing process are flushed into the outer cylinder first. The possibility of twice contamination is further reduced when the clothes is dewatered.

Embodiment 7

Figure 7:
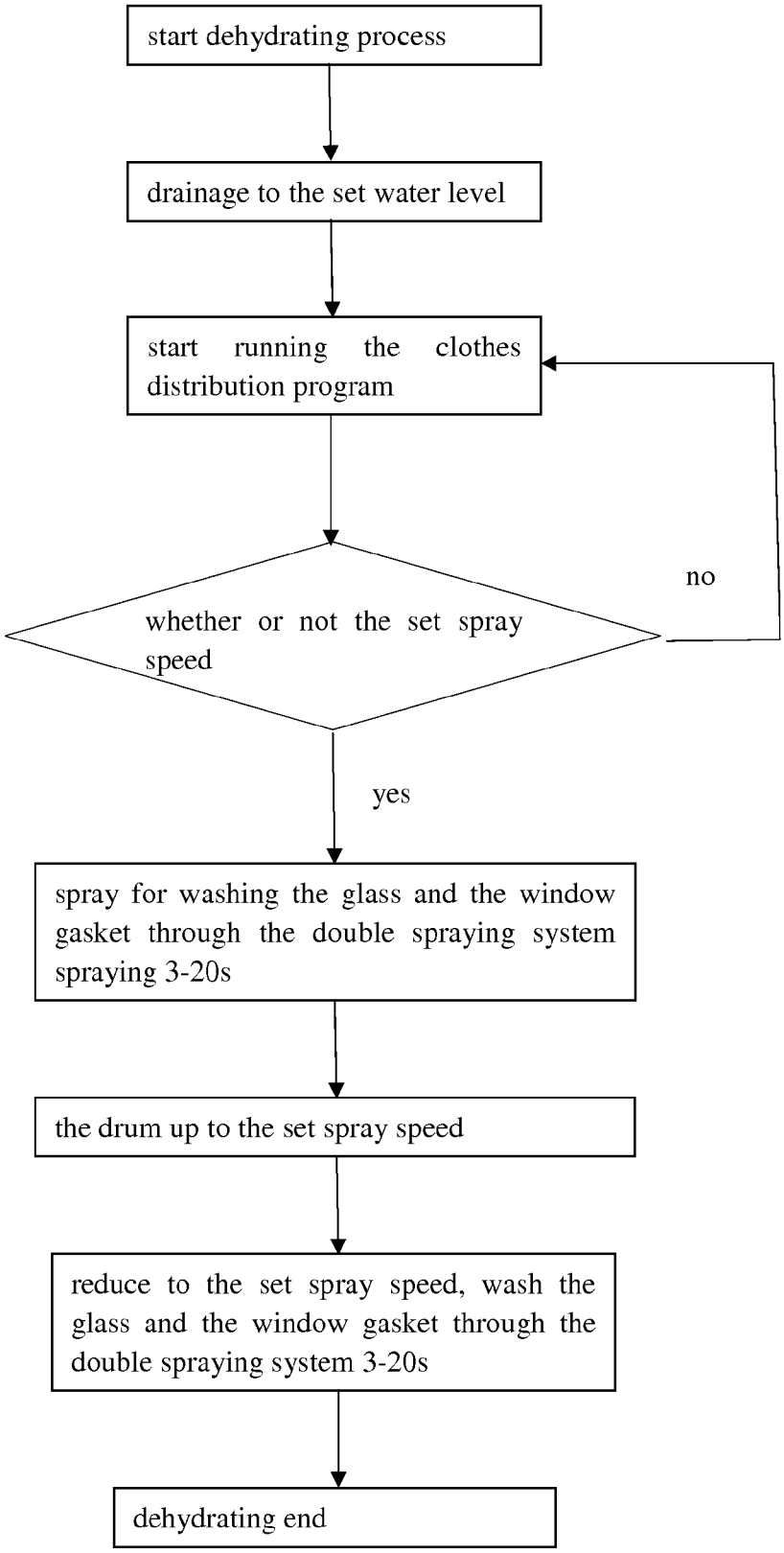
FIG. 7 shows a schematic illustration of the work flow of the double spraying system of the present invention in dehydrating process.

The embodiment adopts the following technical scheme to realize cleaning the watching window and the window gasket ring in dehydrating process. The washing method in the dewatering process in the embodiment can be used alone, and also can be used in combine with Embodiment 5 or/and Embodiment 6. As shown in FIG. 7, the work flow of the double spraying system is:

The washing machine drains to a set water level of empty tub, then running the clothes distribution program. Until the rotating speed is up to the set spraying speed, the double spraying system is started for spraying the watching window and the window gasket ring for 1 to 20 s. The rotating speed of the drum continues to increase, until it reaches the set highest speed. When the rotating speed of the drum is reduced to the set spraying speed again, the double spraying system is started again for spraying the watching window and the window gasket ring for 1 to 20 s. Preferably, the time of adding water through the double spraying system is 3-20 s, more preferably, the washing time is 5 s, 12 s or 20 s. The rotating speed of the drum continues to reduce, until the completion of dehydration.

The clothes distribution program controls the rotating speed of the drum to increase from 45 r/min to 93 r/min equably, making the clothes disperse uniformly on the wall of the drum.

Embodiment 8

Figure 8:
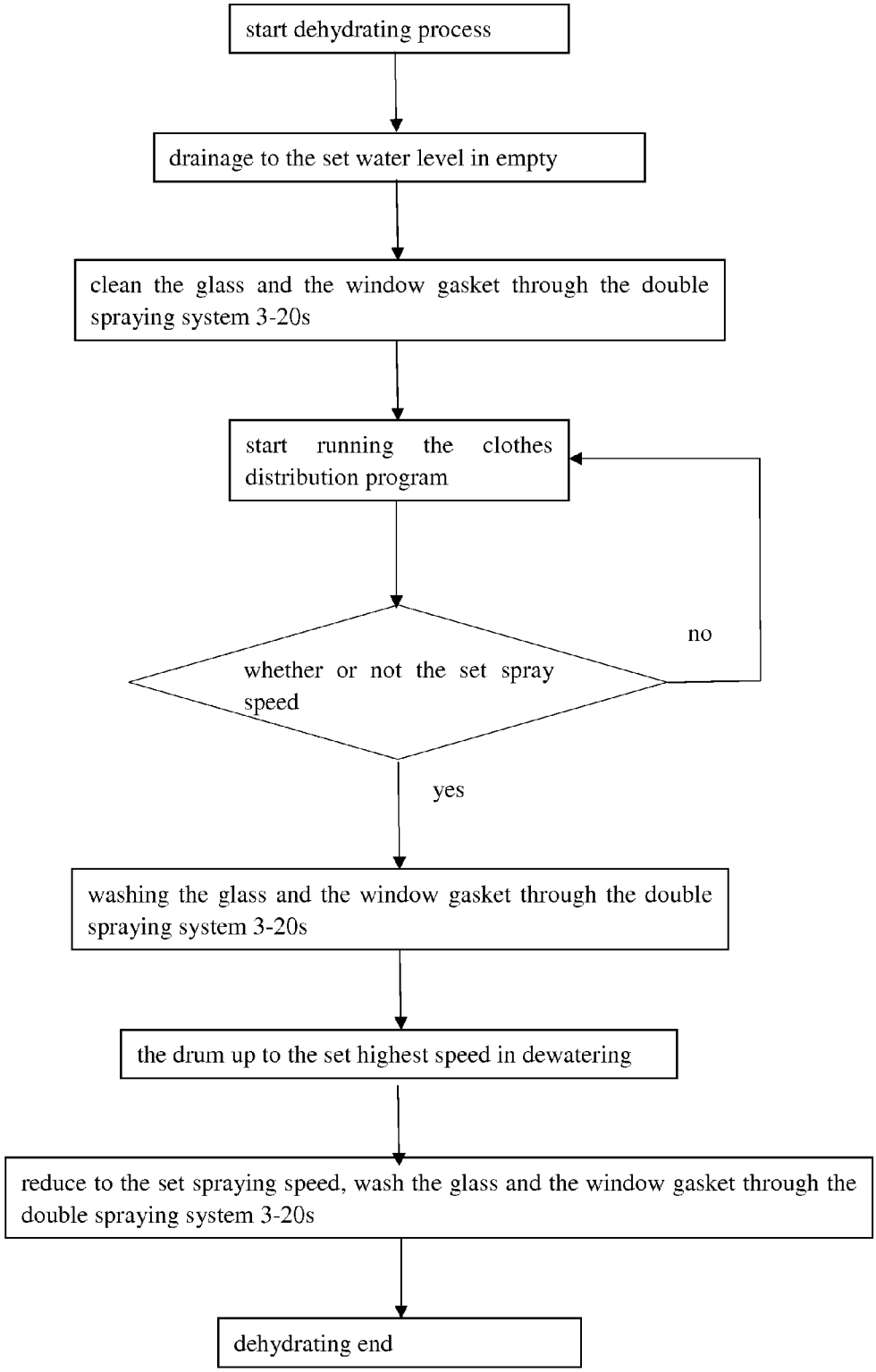
FIG. 8 shows a schematic illustration of the work flow of the double spraying system of the present invention in dehydrating process in another embodiment.

The only difference from Embodiment 7 is that: after the washing machine drains to the set water level of empty tub and before running the clothes distribution program, the double spraying system is started for spraying the watching window and the window gasket ring for 1 to 20 s (referring to FIG. 8).

Embodiment 9

The drum washing machine in the invention, includes the spraying washing device which is connected to the inlet solenoid valve of the washing machine through water pipes. The drum washing machine realizes to clean the watching window and the window gasket ring through the spraying washing method.

The implementation scheme of the embodiments can be replaced further, and the embodiments are just described preferably embodiments of the invention, not to limit the concept and scope of the invention. In the premise of the design concept, the various changes and improvements that are made by of the skilled person in the art according to the technical scheme of the present invention in the field are in the scope of the invention.

The invention claimed is:

1. A drum washing machine with a spraying washing device, wherein:

the spraying washing device comprises an inlet solenoid valve, an inlet pipe and a three-way pipe connected in sequence;

the inlet solenoid valve is connected with a controller of the washing machine;

the three-way pipe is connected with a first spraying nozzle for washing an outer surface of a watching window and a window gasket ring and a second spraying nozzle for washing an inner wall of a fold of the window gasket ring through two bypass pipes respectively;

the first spraying nozzle comprises a water inlet and a spraying mouth, and forms an L-shaped flow passage;

the spraying mouth diverges in a spraying direction at an angle in a range of 30° to 150°;

the window gasket ring is bent to form the fold, which is a groove-shaped fold on a front of an opening of an outer cylinder;

the second spraying nozzle is arranged in the groove-shaped fold through a top of the window gasket ring; and the second spraying nozzle is provided with spraying mouths distributed on two sides toward both a clockwise circumferential direction of the window gasket ring and a counterclockwise circumferential direction of the window gasket ring.

2. The drum washing machine with the spraying washing device according to claim 1, wherein the window gasket ring is arranged between a clothes feeding opening of a door of the washing machine and the opening of the outer cylinder.

3. The drum washing machine with the spraying washing device according to claim 1, wherein:

water sprays from the spraying mouths of the second spraying nozzle toward the clockwise and counterclockwise circumferential directions of the window gasket ring, flows along the inner wall of the groove-shaped fold, and converges on a bottom of the window gasket ring; and after washing the inner wall of the groove-shaped fold, the water is drained into the outer cylinder from a water outlet on the bottom of the window gasket ring.

4. The drum washing machine with the spraying washing device according to claim 1, wherein:

the first spraying nozzle is through the window gasket ring, and is arranged above the watching window, the spraying mouth of the first spraying nozzle is toward the watching window and the window gasket ring, and the water flows down along the outer surface of the watching window and the window gasket ring after spraying, and finishes cleaning the outer surface of the watching window and the window gasket ring.

5. The drum washing machine with the spraying washing device according to claim 2, wherein:

water sprays from the spraying mouths of the second spraying nozzle toward the clockwise and counterclockwise circumferential directions of the window gasket ring, flows along the inner wall of the groove-shaped fold, and converges on a bottom of the window gasket ring; and after washing the inner wall of the groove-shaped fold, the water is drained into the outer cylinder from a water outlet on the bottom of the window gasket ring.

* * * * *